US008629384B1

(12) United States Patent
Biellak et al.

(10) Patent No.: US 8,629,384 B1
(45) Date of Patent: Jan. 14, 2014

(54) PHOTOMULTIPLIER TUBE OPTIMIZED FOR SURFACE INSPECTION IN THE ULTRAVIOLET

(75) Inventors: Stephen Biellak, Sunnyvale, CA (US); Daniel Kavaldjiev, San Jose, CA (US); Stuart Friedman, Palo Alto, CA (US)

(73) Assignee: KLA-Tencor Corporation, Palo Alto, CA (US)

( * ) Notice: Subject to any disclaimer, the term of this patent is extended or adjusted under 35 U.S.C. 154(b) by 305 days.

(21) Appl. No.: 12/910,230

(22) Filed: Oct. 22, 2010

Related U.S. Application Data

(60) Provisional application No. 61/254,977, filed on Oct. 26, 2009.

(51) Int. Cl.
*H01J 40/14* (2006.01)
*H01J 40/00* (2006.01)
*H01J 40/06* (2006.01)

(52) U.S. Cl.
USPC ..... 250/207; 313/539; 313/542

(58) Field of Classification Search
USPC ..... 250/207, 214 VT; 313/539, 542–544, 313/103 R, 103 CM
See application file for complete search history.

(56) References Cited

U.S. PATENT DOCUMENTS 3,787,610 A * 1/1974 Murphy et al. ..... 348/101
3,997,779 A * 12/1976 Rabl ..... 250/207
4,853,595 A * 8/1989 Alfano et al. ..... 313/532
5,680,008 A * 10/1997 Brandes et al. ..... 313/533
6,201,601 B1 3/2001 Vaez-Iravani
6,580,215 B2 * 6/2003 Nihashi ..... 313/542
6,670,752 B2 * 12/2003 Kinoshita et al. ..... 313/542
7,417,721 B2 * 8/2008 Uto et al. ..... 356/237.2
7,455,565 B2 * 11/2008 Machuca et al. ..... 445/51
2007/0013898 A1 * 1/2007 Wolters et al. ..... 356/237.2

FOREIGN PATENT DOCUMENTS

JP 2006302843 A * 11/2006

* cited by examiner

*Primary Examiner* — Thanh Luu
(74) *Attorney, Agent, or Firm* — Deborah Wenocur

(57) ABSTRACT

Disclosed herein is a PhotoMultiplier Tube (PMT) designed for use with a surface inspection system such as the Surfscan system, which operates at 266 nm wavelength. The inventive PMT is high efficiency, low noise, and low gain, a combination of features that is specific to the application and contrary to the features of PMT's in the art. The inventive PMT is designed to be tuned to a specific narrow band wavelength of incident light, thereby optimizing the QE at that wavelength. It is further designed to combine a small number of dynodes each having substantially higher secondary electron gain than typical dynodes. By designing the PMT in this way, the excess noise factor is dramatically reduced, yielding a much improved S/N, while still maintaining the overall PMT gain in the lower range suitable for use in a surface inspection system.

4 Claims, 3 Drawing Sheets

PHOTOMULTIPLIER TUBE OPTIMIZED FOR SURFACE INSPECTION IN THE ULTRAVIOLET

CROSS REFERENCE TO RELATED APPLICATION

This application is related to U.S. Provisional application No. 61/254,977, filed Oct. 26, 2009, and claims priority therefrom.

FIELD OF THE INVENTION

This invention relates to inspection of wafers for integrated circuits, and in particular to the development of a photomultiplier tube designed for optimum performance with a wafer inspection system for unpatterned wafers.

BACKGROUND

Wafer inspection systems for inspecting bare or unpatterned wafers are important in many ways, such as qualifying bare wafers, detecting surface anomalies, inspecting rough films, etc. U.S. Pat. No. 6,201,601, issued Mar. 13, 2001, describes a wafer inspection system for bare or unpatterned wafers, made by KLA-Tencor, Inc., generally referred to as the SurfScan system. U.S. Pat. No. 6,201,601 is hereby incorporated by reference in its entirety.

Detectors utilized in wafer inspection systems such as Surfscan include photomultiplier tubes (PMT's). However, as will be described, the desirable characteristics of photomultiplier tubes used in wafer inspection applications differ greatly from those of typical photomultiplier applications, and therefore photomultiplier tubes found in the art are ill suited to wafer inspection.

FIG. 1 illustrates the main features of photomultiplier tubes. Photomultipliers 100 are generally constructed from a glass envelope 102 with a high vacuum inside, which houses a photocathode 110, several dynodes 115, and an anode 120. Incident photons strike the photocathode material, which in transmission mode may be a thin deposit on the entry window of the device, with electrons 105 being produced as a consequence of the photoelectric effect. These electrons are directed by the focusing electrode 125 toward the electron multiplier 130, where electrons are multiplied by the process of secondary emission.

The electron multiplier consists of a number of electrodes called dynodes. Each dynode is held at a more positive voltage than the previous one. The electrons leave the photocathode, having the energy of the incoming photon (minus the work function of the photocathode). As the electrons move toward the first dynode, they are accelerated by the electric field and arrive with much greater energy. Upon striking the first dynode, more low energy electrons are emitted, and these electrons in turn are accelerated toward the second dynode. The geometry of the dynode chain is such that a cascade occurs with an ever-increasing number of electrons being produced at each stage. Finally, the electrons reach the anode, where the accumulation of charge results in a sharp current pulse indicating the arrival of a photon at the photocathode.

Generally, photomultiplier tubes are used in applications which are light-starved, i.e., very high signal gains are desirable. Typically, photomultiplier tubes allow for gains up to one million. In addition, they preferably incorporate photocathodes that respond to a wide variety of wavelengths. Exemplary photocathodes for typical applications may include bi-alkali photocathodes fabricated from a mixture of cesium and potassium. A list of exemplary PMT photocathode materials is found in *Photomultiplier Tubes: Basics and Applications* (*Second Edition*), Hamamatsu Photonics, Hamamatsu City, Japan, (1999), pg 34, 54. An example of a photomultiplier tube configuration yielding gains near 1 million is a 9 or more dynode configuration, with secondary emission factors of 6 to 7 per dynode. For example, $9^6$ gives a potential gain of 531,441.

SUMMARY OF THE INVENTION

Disclosed herein is a PMT designed for use with a surface inspection system such as the Surfscan system, which operates at 266 nm wavelength. The inventive PMT is high efficiency, low noise, and low gain, a combination of features that is specific to the application and contrary to the features of PMT's in the art. The inventive PMT is designed to be tuned to a specific narrow band wavelength of incident light, thereby optimizing the QE at that wavelength. It is further designed to combine a small number of dynodes each having substantially higher secondary electron gain than typical dynodes. By designing the PMT in this way, the excess noise factor is dramatically reduced, yielding a much improved S/N, while still maintaining the overall PMT gain in the lower range suitable for use in a surface inspection system.

Also disclosed herein is a surface scanning inspection system utilizing PMT tubes having at least a plurality of the features described above.

DETAILED DESCRIPTION

Figure 1:
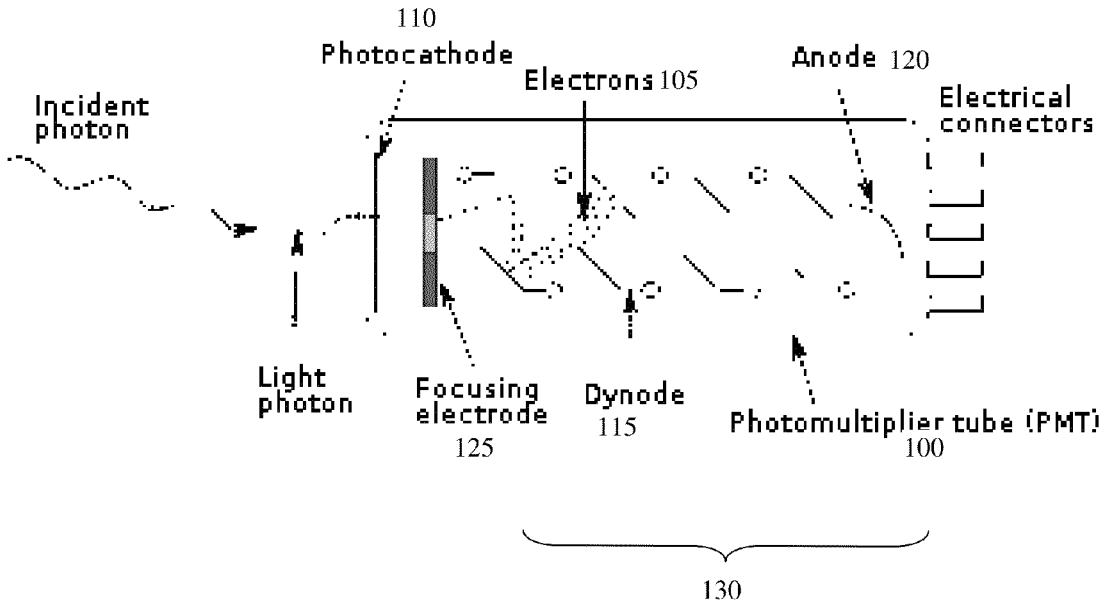
FIG. 1 illustrates the main features of photomultiplier tubes.
Figure 2:
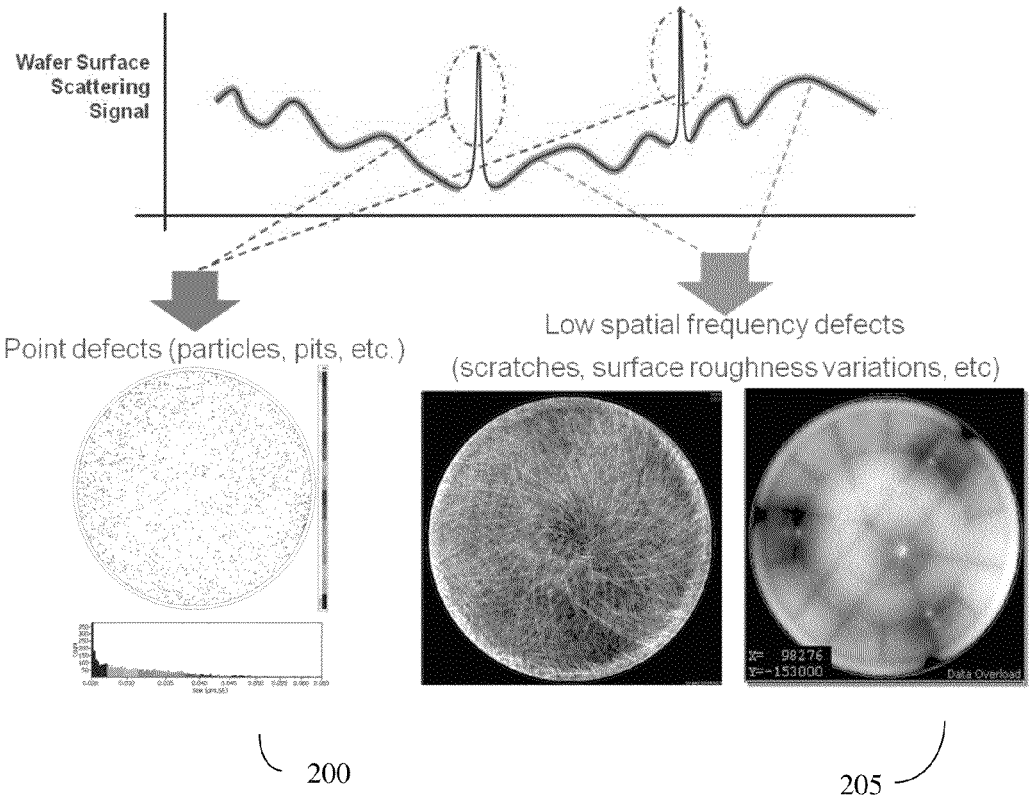
FIG. 2 illustrates high frequency data and low frequency data and the associated features on the wafer.

In contrast to photomultiplier requirements for typical applications, the requirements for photomultiplier tubes used in unpatterned surface inspection are quite different. First, a typical surface inspection system operates at a single ultraviolet wavelength, and therefore the photomultiplier tube need not be sensitive to any other wavelengths; preferably, a PMT will be particularly tuned to the specific UV wavelength of the inspection system. Secondly, the electron gain requirements of a PMT incorporated in a surface inspection system are relatively modest, between about 50 and 50,000 (at least an order of magnitude less than conventional PMT's). A PMT gain in the range between about 50 and 50,000 will be hereinafter referred to as "low gain". The gain requirements are fairly low because the levels of incident light are relatively high, up to tens of nanowatts. Many other PMT applications, such as high energy physics or medical instrumentations, have background light levels several orders of magnitude smaller. But in addition to the gain requirements being modest, higher gain levels are inconsistent with wafer inspection uses. This is because, in surface inspection systems, there is a continuous level of low-frequency (often approximated as DC) background, also known as haze, always incident on the PMT. Typical signal levels of the haze are tens of nanowatts. In most applications a constant signal background is subtracted out, and the remaining signal is highly amplified. However, in the case of wafer inspection, the background haze signal contains important information about the low spatial frequency wafer surface characteristics such as scratches, surface roughness variations, etc, and therefore needs to be preserved. FIG. 2 illustrates high frequency data 200 and low frequency data 205 and the associated features on the wafer. This haze can saturate or degrade the current output of the PMT quickly, if it is amplified by a large gain to greater than about 10 microamps.

Although PMT gain requirements in inspection systems are modest, optimization of Signal to Noise (S/N) is critical, due to the relatively high background signal. All other well-known means of increasing signal-to-noise in an inspection system, for example, scanning more slowly, or using more laser power, require substantial increases in cost, or decreased inspection speed, and therefore are not preferred solutions. It may be possible to reduce the background signal, while maintaining the amplitude of the signal from point defects or particles, but in doing so, information regarding the surface quality of the wafer, as mentioned above, would be lost.

To optimize S/N, a parameter known as DQE (Detective Quantum Efficiency) must be optimized. DQE may be defined as $(S/N)^2_{out}/(S/N)^2_{in}$. DQE is a measure of how the available signal-to-noise ratio is degraded by the imaging system, or in this case by the signal amplification of the PMT. It has a value between 0 and 1, with a larger value indicating less S/N degradation. DQE may also be defined as the quantum efficiency of the PCT photocathode, divided by the statistical Excess Noise Factor (ENF) of the dynode chain. Therefore, to maximize DQE, the ENF must be minimized.

The ENF occurs because each dynode emits a binomially distributed number of electrons for each arriving electron. The statistical variation of current arriving at the anode even for a constant current impinging on the cathode translates into noise. The ENF factor can be expressed as a sum of terms, one for each dynode stage, where each stage adds an uncertainty term obtained by multiplying the uncertainty of the previous stages, as follows:

$$\mathrm{ENF}=1+1/G_{dynode1}G_{dynode2}+\ldots+1/G_{dynode1}G_{dynode2}G_{dynodeN} \quad (1)$$

where the G terms are the secondary electron gain factors for each dynode stage. The dynodes or dynode stages are numbered by their position on the dynode chain; i.e., dynode 1, which will hereinafter be interchchangeably referred to as the primary dynode or the first dynode, is the dynode struck first by electrons directly emitted from the photocathode; dynode 2 is the second dynode in the chain, etc.

Since the first dynode contributes the most to the excess noise, a convenient approximation is that the ENF is roughly 1+1/(secondary electron gain factor of the first dynode). For typical gain values of 5-7, this might correspond to ENF ~1.25, or

DQE~QE/1.25

Since typical QE for PMT's are on the order of 0.3, this translates into DQE of approximately 0.225. Therefore, typical PMT's have DQE less than a quarter of the ideal value of 1.

Following are several aspects of an embodiment of a PMT for use in a scanning surface inspection system.

A. Quantum Efficiency

The inventive PMT in an exemplary embodiment utilizes a photocathode constructed out of appropriately doped and cesiated Gallium Nitride or Zinc oxide. *Uchiyama et al, Applied Physics Letters* 86, 103511, 2005, describes Mg-doped GaN-based photocathodes with extremely high quantum efficiency; maximized to be 71.9% at a photon energy of 5.4 eV (corresponding to about 230 nm wavelength) with a Mg-doping concentration of $3.0\times10^{19}$ $cm^{-3}$. The paper discloses a phototube with the GaN-based photocathode demonstrating a very high QE, more than 50%, and a sharp cutoff characteristic. GaN is also a useful material for the photocathode because it can be deposited in a controlled fashion, giving it more uniform properties than the bialkali and trialkali metal photocathodes of the past, which have typically been deposited with a trial and error approach. The aforementioned paper by Uchiyama et al is hereby incorporated by reference in its entirety. At 266 nm light, the energy of the incident light for the Surfscan system, GaN absorbs approximately 80% of the incident radiation at normal incidence. If the GaN were to be nanostructured with a design optimized for 266 nm, then virtually all of the 266 nm light would be absorbed, yielding additional quantum efficiency. Nanostructuring will be described in more detail below. A description of GaN photocathodes in PMT's, and specifically QE at 266 nm, is found in http://psec.uchicago.edu/photocathodeConference/talks/9-Timothy_Norton.pdf. Note that there are a number of potential wavelengths of interest—248 nm, 261 nm, 265 nm, 266 nm—all of which would benefit from the use of a well-designed GaN photocathode deposition and activation process.

B. Wavelength Tuning

An exemplary embodiment of the inventive PMT is optimized for use with a surface inspection system operating at 266 nm wavelength, as in the Surfscan system. Note, as described below, that the PMT, with minor modifications, can be alternately optimized for a different wavelength.

The above description of optimizing QE by utilizing a cesiated GaN or ZnO photocathode with appropriate doping touches on one aspect of tuning the PMT to a particular incident light energy. Another aspect is the possibility of texturing the photocathode on the nanometer level to absorb the incident light energy, 266 nm by way of example. Details about using nanotexturing to tune the absorption of the photocathode are found in *Klaus Atenkofer, Problems and Obstacles for Developing Nanostructured Photocathodes; First Workshop on Photocathodes; University of Chicago, Jul.* 21, 2009 which is hereby incorporated by reference in its entirety.

Another tool for tuning the PMT to a particular incident light energy is the use of narrowband antireflective coatings. For example, the PMT may have a narrowband 266 um antireflective coating applied to the glass envelope enclosing the vacuum-sealed photocathode and dynode structures. In this way, for a reflective-mode PMT device, the amount of 266 nm light reaching the photocathode can be up to 100% of the incident power, rather than 80%, as would be the case for a non-AR coated glass window. The AR coating is also optimized over the range of angles of incidence delivered to the PMT from the inspection system collection optics. Note that for a transmission mode photocathode, the window or envelope could be coated on the non-photocathode side. For a reflective mode photocathode, the window or envelope could be coated on both the air and vacuum side.

Figure 3:
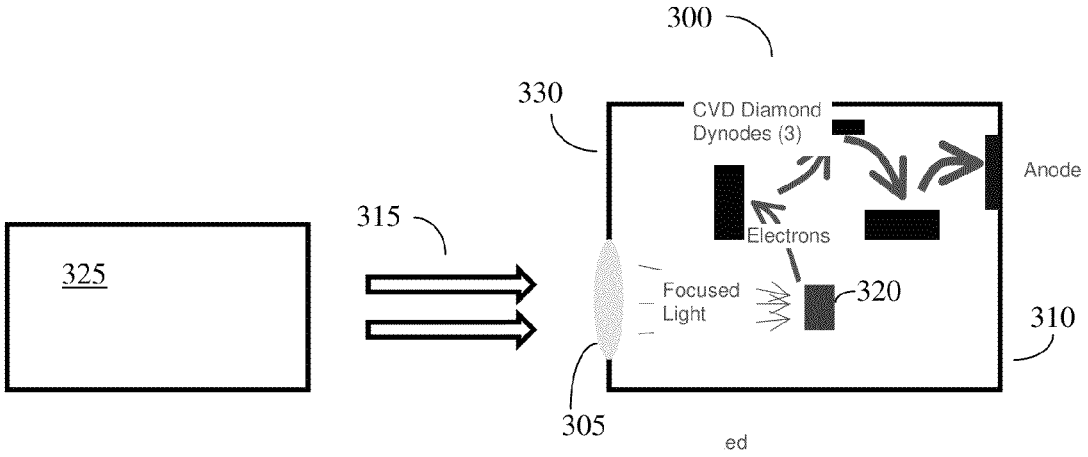
FIG. 3 illustrates a PMT with a microlens, and an associated inspection system.

Referring to FIG. 3, the PMT 300 may also have a small "micro" lens 305 attached, or built into, the glass envelope 310, designed to optimally concentrate, or spread out, the incident light 315 from inspection system 325, such as 266 nm laser light, for optimal absorption by the photocathode 320. The design is in conjunction with input beam parameters, as well as known photocathode geometry, absorption, and emission characteristics. For instance, if the inspection system 325 optimally produces a 10 mm×10 mm spot at the entrance face 330 of PMT 200, but the size of photocathode 320 is optimally 5 mm×10 mm, the micro lens 305 will demagnify the input light by a factor of 2 in the size-mismatched direction. FIG. 3 illustrates an exemplary reflective mode device where photocathode 320 is separated from entrance face 330 of PMT 200. Photocathode 320 can, in some reflective mode embodiments, be inclined at an angle to incident light 315. In such embodiments it could prove advantageous to geometrically structure the light to accommodate and mitigate any inevitable non-uniformities of photocathode photon absorption and electron emission.

C. Excess Noise Factor

An exemplary embodiment of the inventive PMT utilizes CVD-deposited diamond dynodes. The diamond dynodes provide substantially higher electron gain (50 to 100) than typical dynodes (5 to 7), which has the effect of dramatically reducing the excess noise factor, from about 1.2 for a gain of 5 to about 1.02 for a gain of 50, using formula (I) above. Alternately, a CVD-diamond dynode could be used as the first dynode (which contributes the most to the excess noise factor), and subsequent dynodes can be constructed from more typically used materials, if more convenient for PMT design and/or fabrication. Diamond diodes are described in http://www.optoiq.com/index/photonics-technologies-applications/lfw-display/lfw-article-display/336816/articles/laser-focus-world/features/detectors-diamond-dynodes-create-new-breed-of-photon-detectors.html.

In addition, in PMT's where most or all of the dynodes are CVD-diamond dynodes, the number of dynodes required to yield a gain in the range optimal for inspection applications is very low, somewhere between one and four, preferably two or fewer, which further reduces the excess noise factor of the PMT.

Standard PMT's which require high gain and sensitivity to a range of wavelengths achieve this performance with a large number of dynodes. The excess noise generated by this configuration is of secondary importance to the generation of a current, from a small number of photons, sufficient to overcome other sources of electronic noise in the instrumentation.

In contrast, the PMT for inspection systems is not light starved, due to the above described haze, and therefore requires more modest gains. However, also due to the haze, excess noise is a serious issue. Therefore, the inventive PMT addresses the excess noise with only one to three diamond dynodes. In order to achieve acceptable QE under these conditions, a PMT such as the exemplary embodiments described herein can be optimized for various single wavelength values such as 193 nm, 198 nm, 213 nm, 266 nm, or 355 nm by way of example. This can be accomplished by optimizing the nanostructuring of the GaN, the AR coating of the tube, and the micro-lens concentrator design for the wavelength of interest. Optimizing the absorption at the wavelength of interest has the effect of optimizing the quantum efficiency of the photocathode.

In summary, although individual elements of the inventive PMT have been utilized in applications, the combination as described herein is not only novel, but is contrary to the teachings of standard PMT art. The very specialized application to, and use with, a wafer inspection system which uses a single wavelength light such as 266 nm for Surfscan, which requires modest gain and low noise along with high QE, allows for a configuration which would be inconsistent with typical PMT requirements.

It is not expected that the invention be restricted to the exact embodiments described herein. Those skilled in the art will recognize that modifications can be made without departing from the inventive concept. For example, other photocathode types can be used such as: a non-nanostructured bialkali photocathode in transmission mode, a non-nanostructured bialkali photocathode in reflection mode, a non-nanostructured trialkali photocathode in transmission mode, a non-nanostructured trialkali photocathode in reflection mode, a nanostructured bialkali cathode optimized for absorption and photoemission at a single UV wavelength of incident light; and a nanostructured trialkali cathode optimized for absorption and photoemission at a single UV wavelength of incident light. The scope of the invention should be construed in view of the claims.

With this in mind, we claim:

1. A photomultiplier tube comprising:

a photocathode composed of high quantum efficiency GaN in reflection mode;

a number of secondary electron gain dynodes between two and four, said dynodes being composed of CVD diamond;

a glass envelope surrounding said photocathode and dynodes, said glass envelope having an entry window coated with an antireflection coating optimized for 266 nm light;

wherein said photomultiplier tube has low gain and low noise, and has a high quantum efficiency at UV light of wavelength 266 nm.

2. A photomultiplier tube comprising:

a photocathode composed of a bialkili material in reflection mode;

a number of secondary electron gain dynodes between two and four, said dynodes being composed of CVD diamond;

a glass envelope surrounding said photocathode and dynodes, said glass envelope having an entry window coated with an antireflection coating optimized for 266 nm light;

wherein said photomultiplier tube has low gain and low noise, and has a high quantum efficiency at UV light of wavelength 266 nm.

3. A wafer surface scanning inspection system including a photomultiplier tube as in claim 1.

4. A wafer surface scanning inspection system including a photomultiplier tube as in claim 2.

* * * * *